US011631935B2

(12) United States Patent
Tischler et al.

(10) Patent No.: US 11,631,935 B2
(45) Date of Patent: Apr. 18, 2023

(54) MULTIPLE ANTENNA SYSTEM FOR MOBILE TELEPHONY

(71) Applicant: Telefonaktiebolaget LM Ericsson (publ), Stockholm (SE)

(72) Inventors: Georg Tischler, Stephanskirchen (DE); Stephan Dandlberger, Rosenheim (DE); Thorge Ralf, Vaihingen / Enz (DE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 24 days.

(21) Appl. No.: 17/052,272

(22) PCT Filed: Apr. 30, 2019

(86) PCT No.: PCT/EP2019/061116

§ 371 (c)(1),
(2) Date: Nov. 2, 2020

(87) PCT Pub. No.: WO2019/211306

PCT Pub. Date: Nov. 7, 2019

(65) Prior Publication Data

US 2021/0050663 A1 Feb. 18, 2021

(30) Foreign Application Priority Data

May 2, 2018 (DE) ..... 10 2018 110 486.3

(51) Int. Cl.

| | |
|---|---|
| ***H01Q 1/24*** | (2006.01) |
| ***H01Q 19/10*** | (2006.01) |
| ***H01Q 21/08*** | (2006.01) |
| ***H01Q 1/52*** | (2006.01) |
| ***H01Q 3/32*** | (2006.01) |

(52) U.S. Cl.

CPC ..... *H01Q 1/523* (2013.01); *H01Q 1/241* (2013.01); *H01Q 3/32* (2013.01); *H01Q 19/10* (2013.01); *H01Q 21/08* (2013.01)

(58) Field of Classification Search

CPC ..... H01Q 1/523; H01Q 1/241; H01Q 3/32; H01Q 19/10; H01Q 21/08; H01Q 21/24; H01Q 1/246

See application file for complete search history.

(56) References Cited

U.S. PATENT DOCUMENTS 6,310,585 B1 10/2001 Marino
7,224,247 B2 * 5/2007 Dean ..... H01P 1/184 333/161

(Continued)

FOREIGN PATENT DOCUMENTS

CN 103219590 A * 7/2013 ..... H01Q 1/246
CN 103219590 B 7/2015
WO 03065505 A1 8/2003

OTHER PUBLICATIONS

International Search Report and Written Opinion for International Patent Application No. PCT/EP2019/061116, dated Jul. 22, 2019, 10 pages.

*Primary Examiner* — Vibol Tan
(74) *Attorney, Agent, or Firm* — Withrow & Terranova, PLLC

(57) ABSTRACT

A multiple antenna system comprises at least two dipole-type radiators with first and second radiator elements, respectively, which are arranged at a distance from a reflector arrangement. A phase shifter arrangement with a phase shifter adjustment device is connected to the first and second radiator elements to adjust the phase relationships between the first radiator elements and between the second radiator elements. A decoupling arrangement is coupled to a decoupling adjustment device. The decoupling adjustment device is mechanically coupled to the phase shifter adjustment device, so that when the phase shifter adjustment device is moved, the decoupling arrangement: is changeable in its length, width and/or shape; or is changeable in its position, (Continued)

whereby the change of position is accelerated or only partially synchronized with the adjusting movement of the phase-shifting device; or is changeable in its position, wherein the decoupling arrangement is arranged within at least one of the radiators.

20 Claims, 12 Drawing Sheets

(56) References Cited

U.S. PATENT DOCUMENTS

| | | | | |
|---|---|---|---|---|
| 7,253,782 | B2 * | 8/2007 | Davies | H01P 1/184 343/757 |
| 7,298,233 | B2 * | 11/2007 | Zimmerman | H01Q 3/32 333/161 |
| 7,301,422 | B2 * | 11/2007 | Zimmerman | H01P 1/184 333/117 |
| 7,427,966 | B2 * | 9/2008 | Boss | H01Q 21/26 343/797 |
| 7,907,096 | B2 * | 3/2011 | Timofeev | H01P 1/184 343/757 |
| 8,350,775 | B2 * | 1/2013 | Obermaier | H01Q 21/062 343/817 |
| 8,841,977 | B2 * | 9/2014 | Jung | H01P 1/184 333/156 |
| 9,160,062 | B2 * | 10/2015 | Goettl | H01Q 1/246 |
| 9,431,703 | B1 * | 8/2016 | Dandlberger | H01P 5/028 |
| 9,614,281 | B2 * | 4/2017 | Peng | H01Q 3/32 |
| 2004/0056818 | A1 * | 3/2004 | Sledkov | H01Q 21/24 343/797 |
| 2016/0301121 | A1 * | 10/2016 | Dandlberger | H01P 5/12 |

* cited by examiner

MULTIPLE ANTENNA SYSTEM FOR MOBILE TELEPHONY

This application is a 35 U.S.C. § 371 national phase filing of International Application No. PCT/EP2019/061116, filed Apr. 30, 2019, which claims the benefit of German Patent Application No. DE 10 2018 110 486.3, filed May 2, 2018, the disclosures of which are incorporated herein by reference in their entireties.

The invention relates to a multiple antenna system which is used particularly in mobile communication.

Such multiple antenna systems comprise several radiators, each transmitting and receiving in a first and in a second polarization plane perpendicular to each other. Both polarization planes must be decoupled from each other as best as possible. To increase the directivity such radiators are usually arranged in front of a reflector. A disadvantage is that the good decoupling between radiation with orthogonal polarization is reduced by the arrangement as an array, especially by the influence of this reflector. In order to improve the decoupling, it is suggested in the state of the art to use so-called decoupling elements, which are arranged in a certain distance to at least one radiator.

The U.S. Pat. No. 6,310,585 B1 shows a multiple antenna system with a phase shifter arrangement. The phase shifter arrangement comprises a push rod that runs underneath the reflector and is operatively connected to a parasitic element. The parasitic element is located on the top of the reflector. Depending on the direction in which the push rod is moved, the parasitic element is moved further towards or away from the reflector.

Such a decoupling element is shown for example in CN 103219590 A. In order to be able to change the decoupling of the two polarizations afterwards, the decoupling element is movably arranged. In particular, the decoupling element is fixed on a push rod which is arranged inside the antenna housing and can be moved along its longitudinal direction. In this case the decoupling element moves in the same direction as the push rod. It is also possible that a translation arrangement is arranged between the push rod and the decoupling element so that the decoupling element moves at a slower or faster speed compared to the movement speed of the push rod. It is also possible that a distance of the decoupling element to the reflector is changed.

A disadvantage of CN 103219590 A is that for some phase adjustments between radiator elements of different radiators transmitting in the same polarization, the decoupling to radiator elements of the same radiators transmitting in the other polarization is insufficient.

It is therefore the object of the present invention to create an improved multiple antenna system for mobile communication solutions in which the individual polarization planes with which different radiators transmit and/or receive are better decoupled from each other.

The object is solved by the multiple antenna system of the present invention according to claim 1. Claims 2 to 23 contain advantageous embodiments of the multiple antenna system according to the invention.

The multiple antenna system according to the invention comprises at least one group of at least two in particular dual-polarized, circularly polarized or elliptically or +−45° polarized dipole-shaped or dipole-type radiators, wherein each of these dipole-type radiators comprises first and second radiator elements. The first radiator elements transmit and/or receive in a first polarization plane and the second radiator elements in a second polarization plane, wherein both polarization planes are perpendicular to each other.

Furthermore, there is a reflector arrangement on which the dipole-type radiators are arranged. A phase shifter arrangement is also provided, which preferably comprises several phase shifters. This phase shifter arrangement is connected to the first and second radiator elements of the radiators. It can adjust the phase relationship between the at least two first radiator elements and between the at least two second radiator elements. Furthermore, there is a phase shifter adjustment device which is in mechanical contact with the phase shifter arrangement and is configured to control the phase shifter arrangement so that it changes the phase relationship between the respective first and the respective second radiator elements. To achieve the best possible decoupling between the two polarization planes, at least one decoupling arrangement is provided, which is arranged on the same side of the reflector arrangement as the at least two dipole-type radiators. Furthermore, there is at least one decoupling adjustment device which is coupled to the at least one decoupling arrangement. The decoupling adjustment device is mechanically coupled to the phase shifter adjustment device, so that in case of an adjustment movement of the phase shifter adjustment device, the at least one decoupling arrangement:

a) is variable in length, width and/or shape; or
b) is changeable in its position, whereby the change of position is accelerated or only partially synchronized with the (e.g. complete) adjustment movement of the phase shifter adjustment device; or
c) is changeable in its position, wherein the at least one decoupling arrangement is arranged within at least one of the at least two radiators.

It is particularly advantageous here that a decoupling adjustment device is used, which is coupled to the phase shifter adjustment device on the one hand and to the decoupling arrangement on the other hand, whereby the decoupling arrangement can thereby be changed in its length, width and/or shape. Thus, even with a different radiation angle (down tilt) caused by a certain phase adjustment, a high decoupling between the two polarization planes can still be achieved. The length and width can be changed, especially for angular decoupling arrangements, whereas the shape can be changed for round decoupling arrangements or those approximating a round shape. Such a controlled change of the decoupling arrangement is not shown in the state of the art. Tilting a decoupling arrangement does not change the length, the width or the shape.

Furthermore, it is also particularly advantageous here if the position of at least one decoupling arrangement can be changed, whereby the change of position is accelerated or only partially synchronized with the entire adjustment movement of the phase shifter adjustment device. This means that the decoupling arrangement moves non-linearly to the adjusting movement of the phase shifter adjustment device. The term "non-linear" is also to be understood as asynchronous. Such a "non-linear" or "asynchronous" movement for the adjusting movement of the phase shifter adjustment device does not only mean a higher or lower speed, but the fact that an adjusting movement of the phase shifter adjustment device does not result in a movement of the decoupling arrangement over the whole distance or the whole angle of rotation. This means that the movement of the decoupling arrangement is decoupled from the adjusting movement of the phase shifter adjustment device or is decoupled over a certain distance. By the wording that the decoupling arrangement is "accelerated" with respect to its position to the adjusting movement of the phase shifter adjustment device it is to be understood that the decoupling arrangement is accelerated or moved to the phase shifter adjustment device in particular over the predominant or over the entire part of the adjusting path of the phase shifter adjustment device. In particular, this means that the phase shifter adjustment device is moved or rotated at a constant speed (acceleration a=0) and the decoupling arrangement accelerates to it, i.e. with an acceleration a>0 or a<0. The decoupling arrangement moves at an accelerated rate, while the phase shifter adjustment device is adjusted without acceleration, i.e. at a constant speed. In particular, the decoupling arrangement is moved in an accelerated manner over a longer period of time, i.e. with an acceleration a>0 and/or a<0, than the phase shifter adjustment device. It would also be possible that the phase shifter adjustment device is moved in accelerated mode with $a=a_1$, where $a_1>0$ or $a_1<0$, whereas the decoupling arrangement is moved in accelerated mode with $a=a_2$, where $a_2>0$ or $a_2<0$, and where $a_2>a_1$ or $a_2<a_1$. The unit for acceleration is $m/s^2$. A merely higher speed is not understood as an accelerated movement. If the phase shifter adjustment device moves with the constant velocity $v_1$ and the decoupling arrangement with the constant velocity $v_2$, where $v_2>v_1$, then the decoupling arrangement does not move accelerated. In principle, it can therefore be said that the decoupling arrangement is moved with an acceleration a>0 or a<0, which is not equal to the acceleration of the phase shifter adjustment device, whereby the latter can also be 0. The acceleration of the decoupling arrangement is preferably greater than $\pm 0.005\ m/s^2$, $\pm 0.01\ m/s^2$, $\pm 0.02\ m/s^2$, $\pm 0.05\ m/s^2$ or greater than $\pm 0.1\ m/s^2$.

Furthermore, it is advantageous if the decoupling arrangement can be changed in its position, whereby the decoupling arrangement is arranged within the at least one radiator, especially in its center or in the area of its center. Thus, a very compact design can be realized in a very simple way.

In the preferred embodiments, the phase shifter adjustment device consists of an adjustment rod, which can be moved along its longitudinal axis and/or rotated around its longitudinal axis to generate the adjustment movement. In particular, this adjustment rod is moved or rotated by an electric motor that can be controlled by the mobile network operator. This allows the directional characteristic of the multiple antenna system to be changed. Since the decoupling arrangement is also rotated in this context, an optimal decoupling of both polarization planes for different radiation angles is achieved. In particular, an optimal decoupling can be achieved for the maximum down tilt angle and for the minimum down tilt angle.

It is particularly advantageous if the decoupling arrangement consists of at least two decoupling surfaces (which are arranged at a distance from the reflector) which are moveable and/or rotatable relative to one another, thereby changing the length, width and/or shape of the at least one decoupling arrangement. In this context it is also advantageous if the at least one decoupling arrangement is movable only along a certain movement path or over a certain angular range of rotation of the at least one adjustment rod of the phase shifter adjustment device synchronously to this adjustment rod, whereby the position changes only over the range of this adjustment movement. This means that if the adjustment rod can be moved e.g. from 0 cm to 10 cm along its longitudinal direction, the position of the decoupling device will only change if the adjustment rod is moved e.g. from 8 cm to 10 cm. No change of the position of the decoupling arrangement would then take place in the first 8 cm of the adjustment movement of the adjustment rod (the decoupling arrangement moves asynchronously, i.e. non-linear to the adjustment rod). The same can also be applied to a rotational movement of the adjustment rod. E.g. there is no change of the position of the decoupling device when turning from 0° to 720° whereas there is a change e.g. from 720° to 1400°. In this context, it is particularly advantageous if the decoupling device can only be moved synchronously with the adjustment rod in the last third or last quarter or last fifth or last sixth of the adjustment movement of the adjustment rod and is not or only asynchronously moved in the remaining range. This results in an optimal decoupling for the maximum or minimum down tilt angle. Furthermore, it is particularly advantageous if the decoupling arrangement within the radiator can be adjusted with respect to its distance from the reflector arrangement.

An embodiment according to the present invention exists if the at least two decoupling surfaces overlap more in plan view before shifting and/or twisting than afterwards. The at least two decoupling surfaces can, for example, be galvanically connected or galvanically separated from each other. Preferably, a dielectric is arranged between the two decoupling surfaces, in particular in the form of a foil, which preferably has a lower coefficient of friction than the decoupling surfaces themselves. Teflon is also preferably used here.

To achieve a movement or rotation of the at least two decoupling surfaces of the decoupling arrangements, the decoupling adjustment device comprises e.g. a shifting element with a first and a second end. A first end of this shifting element is connected to one (e.g. the first) decoupling surface. The other (e.g. the second) decoupling surface is arranged stationary. The second end of the shifting element is again connected to the adjustment rod, so that during an adjustment movement of the adjustment rod the at least two decoupling surfaces are moved or rotated against each other. The shifting element and the adjustment rod can e.g. consist of a single work piece (one-piece construction).

A distance between the at least two decoupling surfaces is preferably less than 10 mm, 8 mm, 6 mm, 4 mm, 2 mm, 1 mm.

To achieve a non-linear movement of the decoupling arrangement to the adjustment rod, it is advantageous if the decoupling adjustment device comprises a shifting element with a first and a second end, the first end being connected to one (e.g. the first) decoupling surface, wherein the other (e.g. the second) decoupling surface is arranged stationary. Alternatively, the first end of the shifting element can also be connected to the decoupling arrangement in principle. In this case the decoupling arrangement would move as a whole and would in particular have a one-piece structure. The adjustment rod also comprises a first driving element, which is arranged on the adjustment rod and protrudes from it. Preferably, the first driving element and the adjustment rod are formed of a single work piece. The first driving element is arranged with the adjustment rod at such a position so that it engages with the adjustment element in particular in the first and/or last 40%, 35%, 30%, 25%, 20%, 15%, 10% or 5% of the movement path, i.e. the adjustment movement along a first movement direction of the adjustment rod, whereby in this region of the movement path, the two decoupling surfaces are moved or rotated relative to each other or whereby in this region of the movement path, the decoupling arrangement can only then be moved synchronously with the adjustment rod. This ensures that for the major part of the adjustment movement there is no movement of at least one of the decoupling surfaces or the decoupling arrangement. Because a change of the decoupling arrangement's position or a movement or rotating of the decoupling surfaces against each other only takes place towards the end of the adjustment movement of the adjustment rod, an additional tuning can be achieved especially at a maximum or minimum down tilt angle or shortly before reaching such a maximum or minimum down tilt angle, thus maximizing, i.e. optimizing, the decoupling of both polarization planes.

By using a second driving element, which is arranged along the longitudinal axis of the adjustment rod at a distance from the first driving element, a rotation or movement of the decoupling surfaces to a starting position or the changing of the position of the decoupling arrangement to the starting position can take place at a different time. For example, a movement of the decoupling arrangement and/or a rotation and movement of the decoupling surfaces can only be achieved shortly before reaching a maximum or minimum down tilt angle position.

In another embodiment of the invention, the decoupling adjustment device comprises a gear wheel arrangement, whereas the adjustment rod comprises teeth which are offset from each other along the longitudinal axis of the adjustment rod or has several screw threads extending along the longitudinal axis of the adjustment rod.

The gear wheel arrangement can be in permanent engagement with the adjustment rod and with one (e.g. the first) decoupling surface, whereas the other (e.g. the second) decoupling surface is arranged stationary, whereby the two decoupling surfaces can be moved or rotated against each other by moving or rotating the adjustment rod. It is particularly advantageous if the gear wheel arrangement and the screw threads are configured in the form of a worm gear, especially in the form of a self-locking worm gear, because in that way an adjustment is only possible if the adjustment rod is rotated by the electric motor. In principle, it would also be possible here if the gear wheel arrangement engages with the teeth only in the first or last 40%, 35%, 30%, 25%, 20%, 15%, 10% or 5% of the movement path of the adjustment rod. In this case the decoupling arrangement would be changed in its position only partially synchronous, i.e. non-linear, to the total movement of the phase shifter adjustment device, i.e. the adjustment rod.

In principle, it would also be possible for the gear wheel arrangement to comprise an eccentric gear wheel which engages with the adjustment rod, i.e. with the teeth of the adjustment rod or the screw threads of the adjustment rod. By such an eccentric gear wheel, the decoupling arrangement can be adjusted in its position in an accelerated manner or the decoupling surfaces can be moved or rotated in an accelerated manner against each other. With an eccentric gear wheel, the distance of the teeth to the axis of rotation changes along the circumference.

Basically, the wording according to which two decoupling surfaces move or rotate against each other is to be understood in such a way that the two decoupling surfaces move away from or towards each other.

In a further embodiment according to the invention, at least one of the two dipole-type radiators comprises a balancing and/or support arrangement. This is arranged with its first end at the reflector arrangement, in particular fastened. A second end of this balancing and/or support arrangement, which is opposite the first end, is further away from the reflector arrangement than the first end. Radiating surfaces of the radiating elements are arranged at the second end of the balancing and/or support arrangement. The balancing and/or support arrangement encloses a receiving room that extends from the first end to the second end. The decoupling arrangement is partly, mainly or completely located in the receiving room. The decoupling adjustment device is in turn in contact with the decoupling arrangement and with the at least one adjustment rod, so that when the adjustment rod is moved or rotated, the distance between the at least one decoupling arrangement and the reflector arrangement can be changed, i.e. it can be moved up and down within the receiving room. This ensures that the already available installation space within the multiple antenna system is optimally utilized and individual radiators can be controlled precisely.

In this context, the decoupling adjustment device preferably comprises a shifting element, which comprises a first and a second end. A first end of the shifting element is hinged to the decoupling arrangement or placed below the decoupling arrangement, whereas the second end of the shifting element is hinged to the adjustment rod. If the adjustment rod is moved along its longitudinal axis, the decoupling arrangement is raised or lowered within the balancing and/or support arrangement. In particular, a longitudinal movement of the adjustment rod can be converted into a lifting movement of the decoupling arrangement. Again, it would be possible that the shifting element with its first end, which is located below the decoupling arrangement, engages the decoupling arrangement only in the last 40%, 35%, 30%, 25%, 20%, 15%, 10% or 5% of the movement path, i.e. of the adjustment rod, whereby the first end of the shifting element presses the decoupling arrangement from below in the direction of the radiator plane only in this region of the movement path. Preferably, the decoupling arrangement would be preloaded by a spring force, so that in case the shifting element moves away again, i.e. is not in engagement with the decoupling arrangement, the decoupling arrangement is pressed down accordingly.

In this context, it would also be possible that a guiding arrangement is still provided, whereby the first end of the shifting element is only guided along a straight line by this guiding arrangement. This straight line should be perpendicular to the reflector arrangement.

In principle, it is advantageous if the decoupling adjustment device is predominantly located on a second side of the reflector arrangement which is free of the first and the at least one second radiator. This ensures that only the decoupling arrangement leads to a decoupling of the polarization planes.

Various embodiments of the invention are described below with reference to the drawings as examples. The same subject-matter has the same reference signs. The corresponding figures of the drawing show in detail:

FIG. 1: a side view of the multiple antenna system according to the invention;

FIG. 2: a top view of the multiple antenna system according to the invention;

FIGS. 3A to 4B: different illustrations which explain how two decoupling surfaces of a decoupling arrangement are moved against each other;

FIGS. 5A and 5B: various illustrations which explain how the position of a decoupling arrangement within a radiator can be changed;

FIG. 6: different illustrations which explain how two decoupling surfaces of a decoupling arrangement are moved against each other;

FIGS. 7A, 7B and 7C: different illustrations which explain how two decoupling surfaces of a decoupling arrangement are rotated against each other;

FIGS. 8A and 8B: different illustrations which explain how two decoupling surfaces of a decoupling arrangement are moved against each other;

FIG. 9: different illustrations explaining how the position of a decoupling arrangement within a radiator can be changed;

FIG. 10A: various illustrations showing how the position of a decoupling arrangement within a radiator can be changed;

FIG. 10B: an illustration explaining how the decoupling arrangement can be inserted from outside a balancing and/or support arrangement via a balancing slot into a receiving room of a radiator;

FIG. 11A: series of measurements of the decoupling between two polarization planes with and without a decoupling arrangement over a frequency range at a Min-Tilt setting of a phase shifter arrangement; and FIG. 11B: series of measurements for the decoupling between two polarization planes with and without a decoupling arrangement over a frequency range with a Max-Tilt adjustment of a phase shifter arrangement.

FIG. 1 shows a side view, wherein the antenna housing of the multiple antenna system 1 is not shown.

FIG. 2 shows a top view of another embodiment of the multiple antenna system 1.

Figure 1:
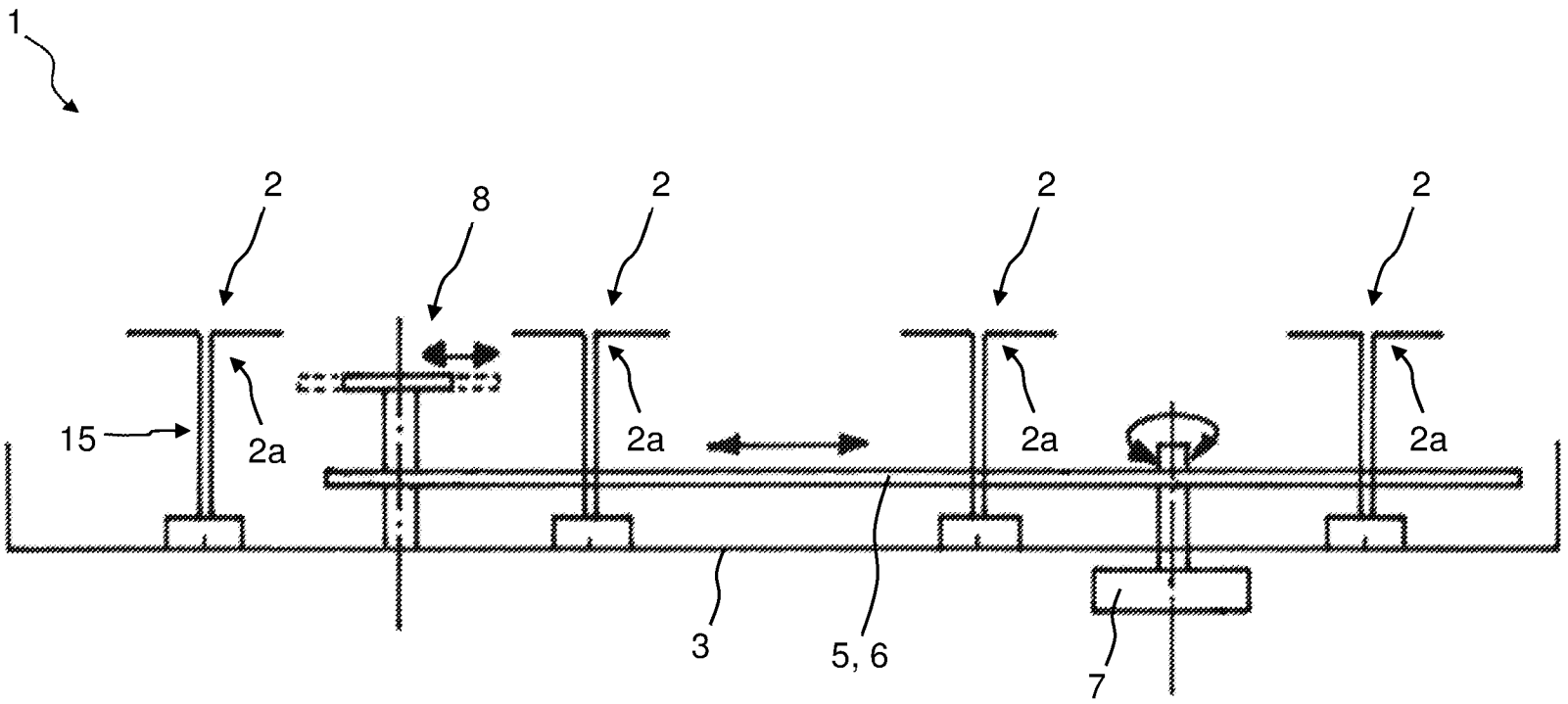
FIGS. 1 and 2 show different illustrations of the multiple antenna system 1 according to the present invention.

The multi-antenna system 1 comprises at least one group of at least two dual-polarized, circular-polarized, ±45°-polarized or elliptically polarized dipole-type radiators 2, wherein each dipole-type radiator 2 comprises first radiator elements 2*a* and second radiator elements 2*b*. The first radiator elements 2*a* are configured to transmit and/or receive in a first polarization plane, whereas the second radiator elements 2*b* are configured to transmit and/or receive in a second polarization plane. Both polarization planes are aligned perpendicular to each other. The decoupling of these polarization planes is to be ensured by the present invention also for different phase relationships between the respective first radiator elements 2*a* of the different radiators 2 and the respective second radiator elements 2*b* of the different radiators 2.

Furthermore, a reflector arrangement 3 is provided, on which the at least two dipole-type radiators 2 are arranged. The dipole-type radiators 2 or preferably all dipole-type radiators 2 are arranged on the same side of the reflector arrangement 3.

Furthermore, a phase shifter arrangement 4 is provided, which is connected to the first and second radiator elements 2*a*, 2*b*. The phase shifter arrangement 4 is configured to adjust the phase relationship between the at least two first radiator elements 2*a* and between the at least two second radiator elements 2*b*.

For this purpose, the phase shifter arrangement 4 comprises a feed connection 4*a* for one polarization plane and various radiator connections 4*b* for connection to the first radiator elements 2*a* or to the second radiator elements 2*b*. The phase shifter arrangement 4 shown in FIG. 2 is provided a second time for the second polarization plane, but is not shown due to space constraints.

Furthermore, at least one phase shifter adjustment device 5 is provided, which is mechanically in contact with the phase shifter arrangement 4 and which is configured to adjust the phase shifter arrangement 4, i.e. in particular to adjust the phase relationships between the first radiator elements 2*a* with respect to one another and the second radiator elements 2*b* with respect to one another, whereby the directional characteristic (down-tilt) can be changed. The phase shifter adjustment device 5 causes the pointer 4*c* of the phase shifter arrangement 4 to be moved accordingly, whereby the applied signal at the feed connection 4*a* is output with a different delay at the radiator connections 4*b*.

Figure 2:
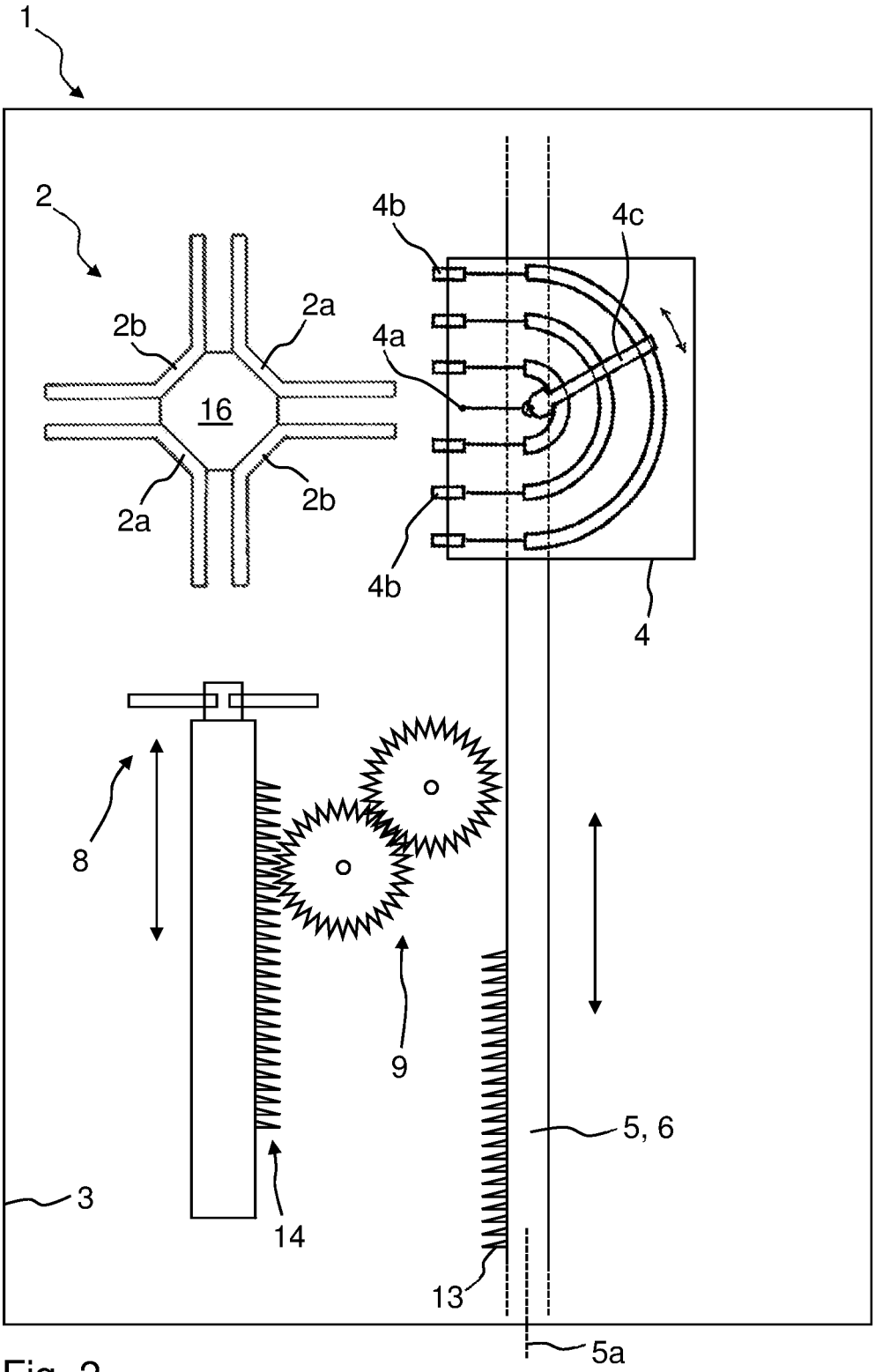

In FIGS. 1 and 2, the phase shifter adjustment device 5 is configured as an adjustment rod 6, which can also be called an adjustment pole. This adjustment rod 6 can be moved along its longitudinal axis 5*a* and/or rotated around its longitudinal axis 5*a* to generate an adjustment movement of the phase shifter arrangement 4.

This movement and/or rotation of the phase shifter adjustment device 5, which in this case is the adjustment rod 6, is preferably done by an electrically driven motor 7. This motor 7 can then be controlled by the mobile network operator of the multiple antenna system 1.

In order to improve the decoupling depending on the phase relationship of the first radiator elements 2*a* to each other and the second radiator elements 2*b* to each other, a decoupling arrangement 8 is provided, which is arranged on the same side of the reflector arrangement 3 as the group of at least two dipole-type radiators 2. The decoupling arrangement 8 consists of or comprises a dielectric material and/or is electrically conductive. In the latter case it may, for example, consist of or comprise a metal.

Furthermore, at least one decoupling adjustment device 9 is provided, which is coupled with the at least one decoupling arrangement 8. This coupling can be mechanical (e.g. by gears) or magnetic. A movement of the decoupling adjustment device 9 leads (preferably always) to a movement of the decoupling arrangement 8.

The at least one decoupling adjustment device 9 is in turn mechanically coupled to the phase shifter adjustment device 5, so that in the event of an adjustment movement of the phase shifter adjustment device 5 the at least one decoupling arrangement 8 either:

a) is variable in length, width and/or shape; or
b) is variable in position, wherein the change of position is accelerated or only partially synchronous with the total displacement of the phase shifting device 5; or
c) is changeable in its position, wherein the at least one decoupling arrangement 8 is arranged within at least one of the at least two radiators 2.

The at least one decoupling arrangement 8 comprises at least two decoupling surfaces 8*a*, 8*b* as shown in FIGS. 6, 7A, 7B, 8A and 8B.

Figure 6:
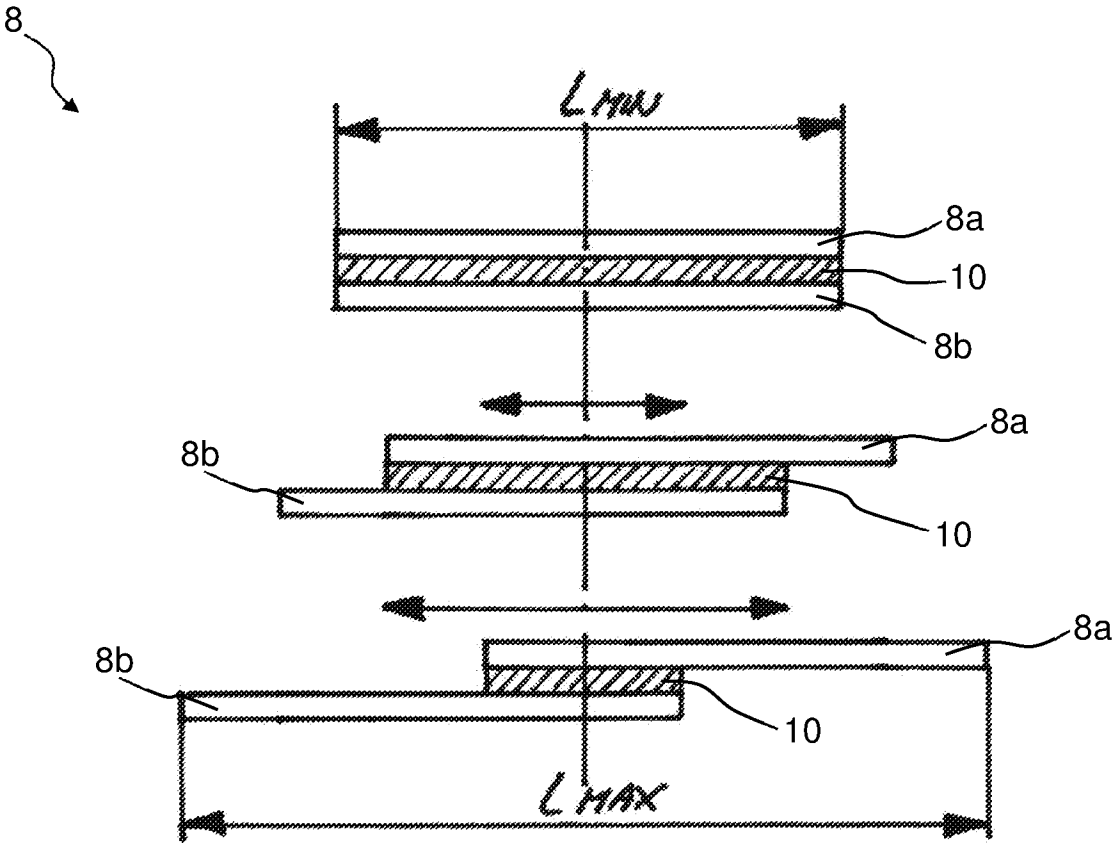

FIG. 6 shows that the two decoupling surfaces 8*a*, 8*b* can be moved against each other, thus changing the length, width and/or shape of the at least one decoupling arrangement 8. In particular, the decoupling surfaces 8*a*, 8*b* are mostly arranged parallel to the reflector arrangement 3. In particular, they are also mostly arranged parallel to the radiator plane of the at least two dipole-type radiators 2. They could also be arranged inclined or even vertical. The decoupling behavior with respect to the length/width change of the decoupling arrangement 8 is frequency dependent.

Figure 7C:
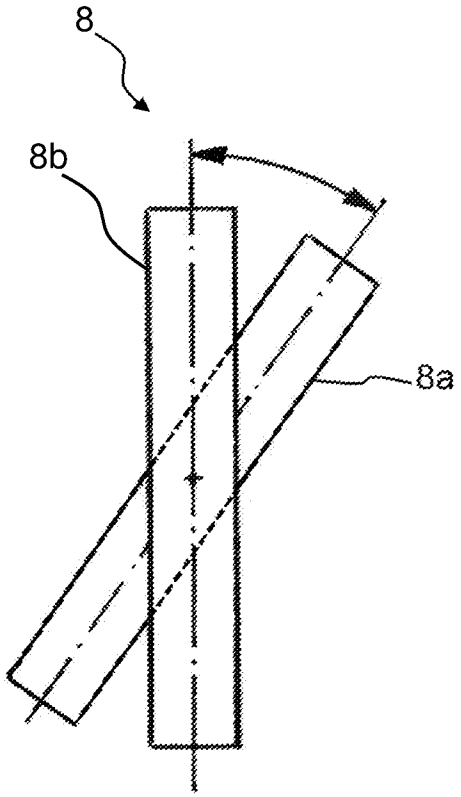
Figure 7B:
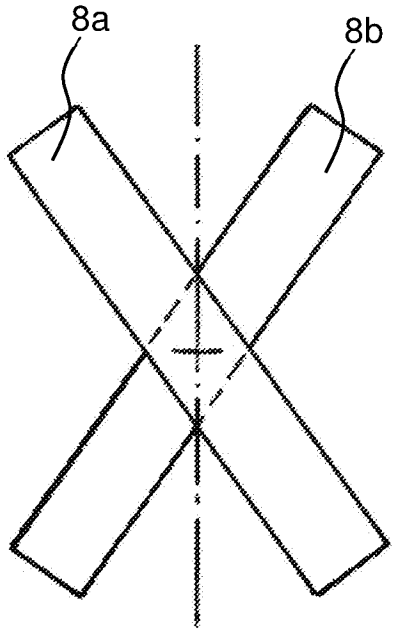
Figure 7A:
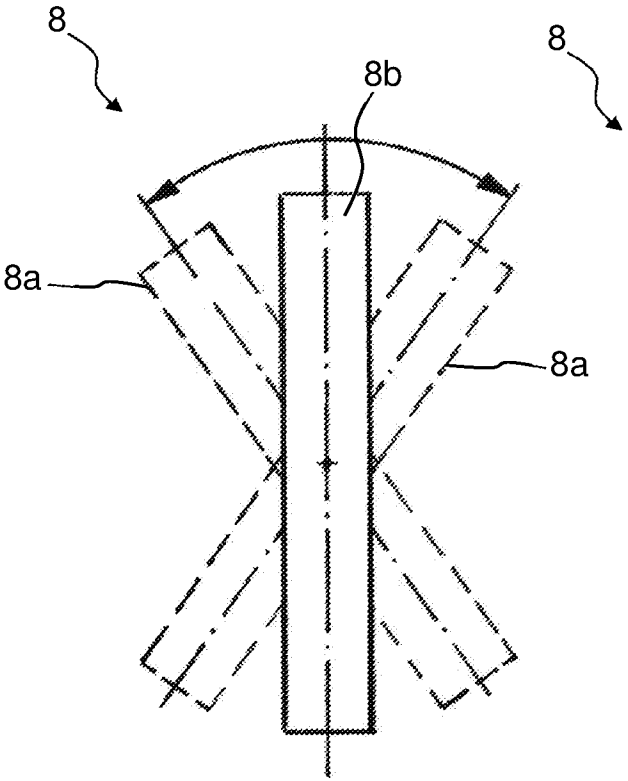

FIGS. 7A, 7B and 7C show that the at least two decoupling surfaces 8*a*, 8*b* can be rotated against each other. The axis of rotation is preferably located in the center of each of the at least two decoupling surfaces 8*a*, 8*b* or it passes through the center of gravity of each of the at least two decoupling surfaces 8*a*, 8*b*.

Figure 8B:
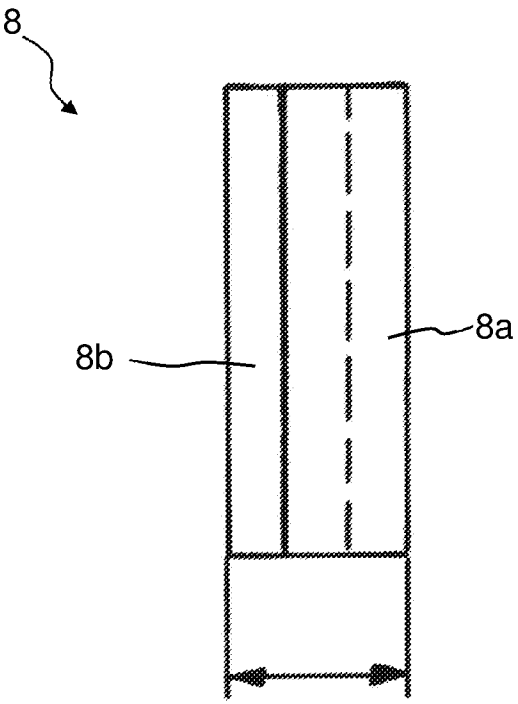
Figure 8A:
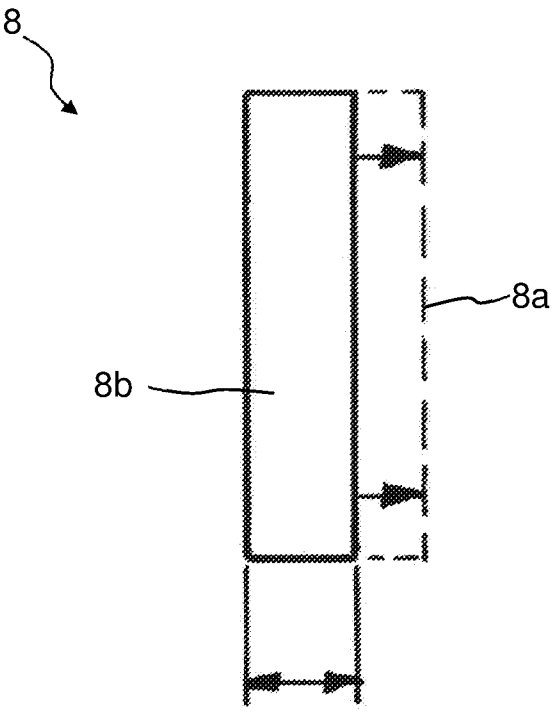

In FIG. 6, moving of the decoupling surfaces 8*a*, 8*b* increases the length of decoupling arrangement 8, whereas in FIGS. 8A and 8B the width increases.

The at least two decoupling surfaces 8*a*, 8*b* of the at least one decoupling arrangement 8 overlap in plan view more before the moving and/or rotating of the at least two decoupling surfaces 8*a*, 8*b* than after the moving and/or rotating.

Between the at least two decoupling surfaces 8*a*, 8*b* a dielectric 10 is preferably arranged. The dielectric 10 is preferably a foil. In principle, the decoupling surfaces 8*a*, 8*b* could also be coated with a dielectric layer, which forms the dielectric.

It is also possible that a free space is formed between the at least two decoupling surfaces 8*a*, 8*b*, thus separating them from each other. In principle, it is also possible that the at least two decoupling surfaces 8*a*, 8*b* are galvanically connected to each other.

The at least two decoupling surfaces 8*a*, 8*b* can themselves consist of a dielectric or a conductive material.

Both decoupling surfaces 8*a*, 8*b* are preferably the same size. They could also be of different sizes. The decoupling surfaces 8*a*, 8*b* preferably have the shape of an n-corner with n≥3, 4, 5, etc. They could also have the shape of an oval, a circle or an n-polygon or be approximated to such a shape.

Both decoupling surfaces 8*a*, 8*b* are spaced from the reflector arrangement 3. Preferably, they are located between the reflector arrangement 3 and the radiator plane of the at least two dipole-type radiators 2. At least one of the decoupling surfaces 8*a*, 8*b* can also be arranged at the height of the radiator plane.

FIGS. 6, 8A and 8B show that the length and/or width of the decoupling arrangement 8 in plan view increases by more than 5%, 10%, 15%, 20%, 25%, 30%, 35%, 40%, 45%, 50%, 55%, 60%, 65%, 70%, 75%, 80%, 85%, 90% when the decoupling surfaces 8*a*, 8*b* are moved. An enlargement of more than 100% is also possible, especially if more than two decoupling surfaces 8*a*, 8*b* are used.

FIGS. 7A, 7B and 7C show that the first and second decoupling surfaces 8*a*, 8*b* can be rotated against each other by more than 5°, 15°, 25°, 35°, 45°, 55°, 65°, 75°, 85°, 90°, 95°, 105°, 115°, 125°, 135°, 145°, 155°, 165°, 175°, 180° or more than 180°.

Preferably, only one of the at least two decoupling surfaces 8*a*, 8*b* is moved or rotated, whereas the other decoupling surface 8*b*, 8*a* is arranged permanently stationary. FIG. 7A indicates that in this case the first decoupling surfaces 8*a* can be rotated clockwise and counterclockwise. The first decoupling surfaces 8*a* is therefore shown as dashed lines. In a default position, both decoupling surfaces 8*a*, 8*b* are congruent or predominantly congruent with each other. Rotating the first decoupling surfaces 8*a* changes the shape of decoupling arrangement 8.

In FIG. 7B, preferably both decoupling surfaces 8*a*, 8*b* can be rotated and are rotated from their default position.

In FIG. 7C, for example, the second decoupling surfaces 8*b* is arranged permanently stationary, whereas the first decoupling surface 8*a* is rotatable. In principle, however, it would also be possible that several or all of the decoupling surfaces 8*a*, 8*b* are arranged in a movable manner and can thus be moved and/or rotated.

It is not shown that the multiple antenna system 1 also comprises a spring device. This can be arranged at the decoupling arrangement 8 in such a way that the decoupling adjustment device 9 must overcome a spring force of the spring force device in order to change the length, width and/or shape or the position of the decoupling arrangement 8. Without such an application of force by the decoupling adjustment device 9, the spring device causes the at least two decoupling surfaces 8*a*, 8*b* to be moved and/or rotated back into a starting position.

Preferably the at least one decoupling arrangement 8 is movable by the decoupling adjustment device 9 only along a certain path of movement or over a certain angular range of rotation of the at least one adjustment rod 6 of the phase shifter adjustment device 5 synchronously therewith, whereby its position or its shape and/or size changes only in this region or only in this path. With regard to FIG. 2, it can be seen that the adjustment rod 6 is not in contact with the decoupling adjustment device 9 over its entire range of movement. However, this situation will be explained in more detail below.

Figure 3A:
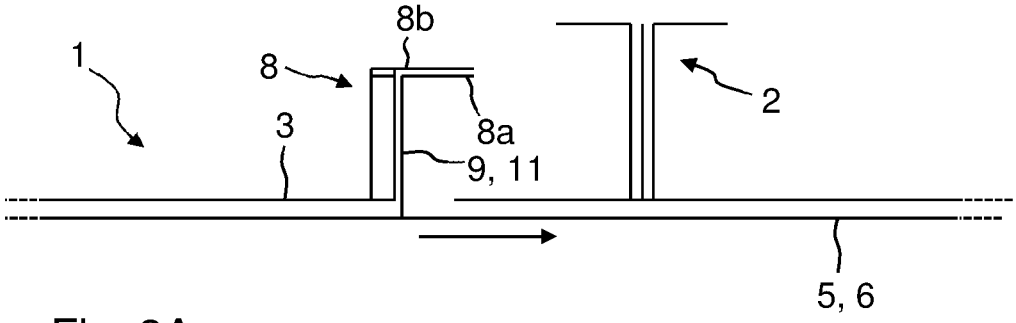
Figure 3B:
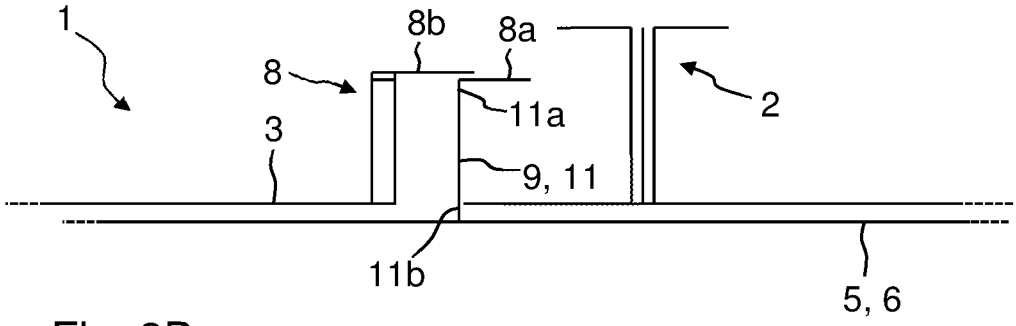

In an embodiment not shown, the decoupling surfaces 8*a*, 8*b* are rotated or moved as soon as the adjustment rod 6 is moved. For this purpose the decoupling adjustment device 9 comprises a shifting element 11, which has a first and a second end 11*a*, 11*b*. The first end 11*a* of this shifting element 11 is connected to the first decoupling surfaces 8*a*, whereas the second decoupling surface 8*b* is arranged stationary. The second end 11*b* of the shifting element 11 is, however, connected to the adjustment rod 6, so that with each adjustment movement of the adjustment rod 6 the at least two decoupling surfaces 8*a*, 8*b* are moved or rotated against each other. The shifting element 11 and the adjustment rod 6 can for example consist of a single work piece or the shifting element 11 can be screwed, connected or welded or soldered to the adjustment rod 6. In this case, there is a synchronous movement between a part of the decoupling adjustment device 8 (i.e. between the first decoupling surface 8*a*) and an adjustment movement of the adjustment rod 6. Such a construction is shown in FIGS. 3A and 3B. The reflector arrangement 3 comprises a corresponding guide recess.

Figure 4A:
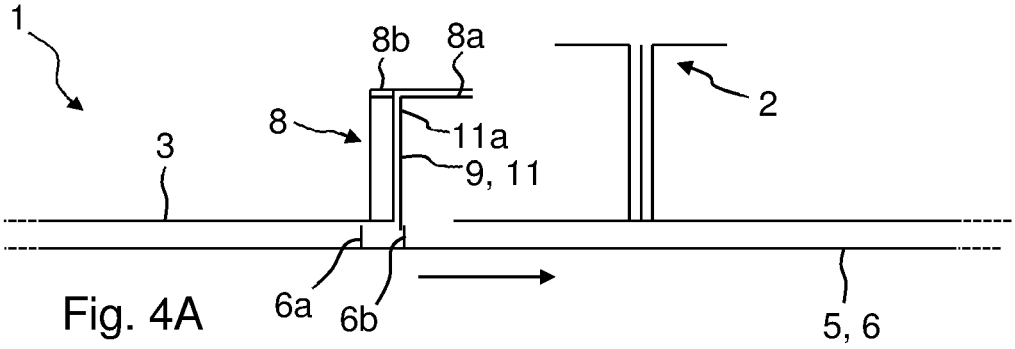
Figure 4B:
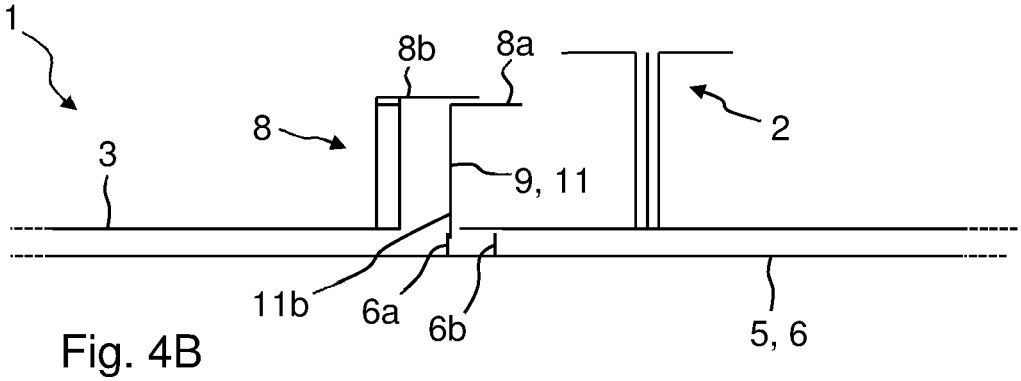

FIGS. 4A and 4B show another embodiment of the decoupling adjustment device 9. In this case, the decoupling adjustment device 9 only moves over a certain movement path (direction of arrow) of the adjustment rod 6. The decoupling adjustment device 9 also comprises a shifting element 11, which has a first and a second end 11*a*, 11*b*. The first end 11*a* is connected to the first decoupling surface 8*a*, whereas the second decoupling surface 8*b* is arranged stationary. It would also be possible that the first end 11*a* of shifting element 11 is directly connected to the overall movable decoupling arrangement 8. The adjustment rod 6 comprises a first driving element 6*a*, which is arranged on the adjustment rod 6 and protrudes outwards from it. The first driving element 6*a* is arranged on the adjustment rod 6 at such a position that it engages with the shifting element 11 only in the last 40%, 35%, 30%, 25%, 20%, 15%, 10% or in the last 5% of the movement path, i.e. the adjustment movement along a first movement direction of the adjustment rod 6, whereby the two decoupling surfaces 8*a*, 8*b* are moved or rotated against each other only in this area of the movement path, or whereby the decoupling arrangement 8 as a whole can be moved synchronously to the adjustment rod 6 only in this area of the movement path. This means that in the other part of the movement path the decoupling arrangement 8 is neither moved in part nor as a whole and overall the decoupling arrangement 8 can be moved asynchronously to the total adjustment movement of the adjustment rod 6.

This construction has the advantage that only shortly before reaching the maximum or minimum down tilt angle an additional decoupling takes place, whereby in this region the polarization planes are then particularly well decoupled from each other.

In FIG. 4A, the first driving element 6*a* is not yet in engagement with the shifting element 11. Only when the adjustment rod 6 moves further to the right (in the direction of the arrow), the first driving element 6*a* engages with the first shifting element 11, thus initiating a shifting movement. The end of the shifting movement is then shown in FIG. 4B.

The first driving element 6*a* is in contact with the shifting element 11 and the first decoupling surfaces 8*a* is closer to the at least one dipole-type radiator 2 than before the shifting movement was initiated.

FIGS. 4A and 4B also show a second driving element 6*b*, which is attached to the adjustment rod 6 and protrudes from it. The second driving element 6*b* is arranged along the longitudinal axis 5*a* of the adjustment rod 6 and is spaced apart from the first driving element 6*a*. The second driving element 6*b* is arranged on the adjustment rod 6 in such a position that it engages with the shifting element 11 only along a second movement direction of the adjustment rod 6, which is opposite to the first movement direction. As a result, the at least two decoupling surfaces 8*a*, 8*b* are moved or rotated against each other, i.e. moved back or rotated back. Alternatively, the entire decoupling arrangement 8 can be moved synchronously to the adjustment rod 6 only in this region of the movement path of the adjustment rod 6. This means that the second driving element 6*b* does not engage with the shifting element 11 along the entire second shifting arrangement, but only along a certain part, preferably along the last 50%, 40%, 30%, 20%, 10% or 5% of the movement path along the second movement direction.

Referring to FIG. 2, however, it is shown that the decoupling adjustment device 9 comprises a gear wheel arrangement which may have one or more gear wheels. The adjustment rod 6 further comprises teeth 13, which are arranged offset to each other along the longitudinal axis 5*a* of the adjustment rod 6. It would also be possible for the adjustment rod 6 to comprise several screw threads that extend along the longitudinal axis 5*a* of the adjustment rod 6. The decoupling adjustment device 9 can be in permanent engagement with the adjustment rod 6 and with the first decoupling surfaces 8*a* via its gear wheel arrangement, wherein the second decoupling surface 8*b* is arranged stationary. By moving or rotating the adjustment rod 6, the two decoupling surfaces 8*a*, 8*b* are moved and/or rotated against each other. Any adjustment movement (moving or rotating) of the adjustment rod 6 could also lead to a movement or rotation of the two decoupling surfaces 8*a*, 8*b* in relation to each other. However, this situation is not shown in FIG. 2.

In FIG. 2, on the other hand, it is shown that the decoupling adjustment device 9 with its gear wheel arrangement engages with the teeth 13 only in the first or last 40%, 35%, 30%, 25%, 20%, 15%, 10% or 5% of the movement path of the adjustment rod 6 along a first movement direction of the adjustment rod 6, whereby only in this region of the movement path the two decoupling surfaces 8*a*, 8*b* can be moved or rotated against each other or the entire decoupling arrangement 8 (as shown in FIG. 2) can be moved synchronously with the adjustment rod 6 in this region of the movement path of the adjustment rod 6. Considering the whole movement of the adjustment rod 6, the two decoupling surfaces 8*a*, 8*b* move non-linearly or asynchronously with respect to the movement path of the adjustment rod 6 or the whole decoupling arrangement 8 moves non-linearly or asynchronously with respect to the movement path of the adjustment rod 6. In other words, at least one decoupling surface 8*a*, 8*b* or the whole decoupling arrangement 8 is only partially coupled to the adjustment rod 6 along its movement path.

In the embodiment of FIG. 2, teeth 14 are also provided on the decoupling arrangement 8, which are in contact with the decoupling adjustment device 9 and within this with the gear wheel arrangement. The decoupling arrangement 8 is preferably in contact with the decoupling adjustment device 9 over its entire range of motion.

It would also be possible that the gear wheel arrangement of the decoupling adjustment device 9 comprises at least one eccentric gear wheel which is in engagement (indirectly or directly) with the adjustment rod 6, whereby the at least two decoupling surfaces 8*a*, 8*b* can be moved or rotated against each other in an accelerated manner or whereby the entire decoupling arrangement 8 can be adjusted in its position in an accelerated manner. The acceleration a is greater than zero or less than zero. At this point in time, the adjustment rod 6 preferably moves at a constant speed or with a different acceleration.

In the following, it will be explained how a structure of the multiple antenna system 1 can look like, where the decoupling arrangement 8 is arranged within at least one of the two radiators 2. Reference is made to FIGS. 5A, 5B, 9 and 10A.

At least one of the at least two dipole-type radiators 2 comprises a balancing and/or support arrangement 15, which is arranged with its first end 15*a* at the reflector arrangement 3. A second end 15*b* of the balancing and/or support arrangement 15, which is opposite the first end 15*a*, is further away from the reflector arrangement 3. Radiator surfaces 17 of the radiator elements 2*a*, 2*b* are arranged at the second end 15*b* of the balancing and/or support arrangement 15. The balancing and/or support arrangement 15 encloses a receiving room 16, which extends from the first end 15*a* to the second end 15*b*. The decoupling arrangement 8 is arranged (in particular predominantly or completely) in the receiving room 16. The decoupling adjustment device 9 is in contact with the decoupling arrangement 8 and the at least one adjustment rod 6, so that when the adjustment rod 6 is moved or rotated, the at least one decoupling arrangement 8 can be changed in its distance to the reflector arrangement 3 within the balancing and/or support arrangement 15.

Figure 5A:
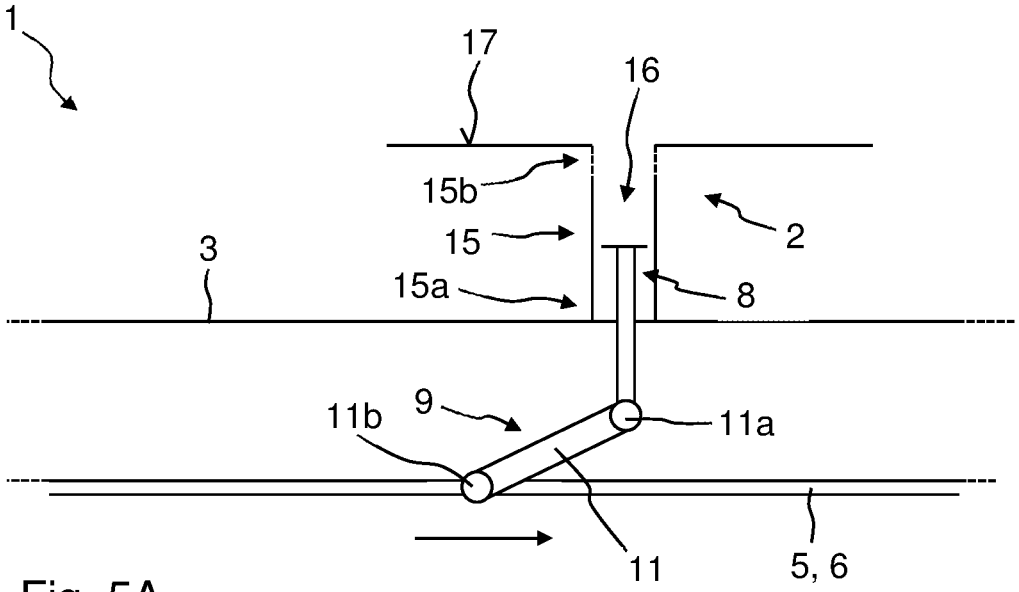
Figure 5B:
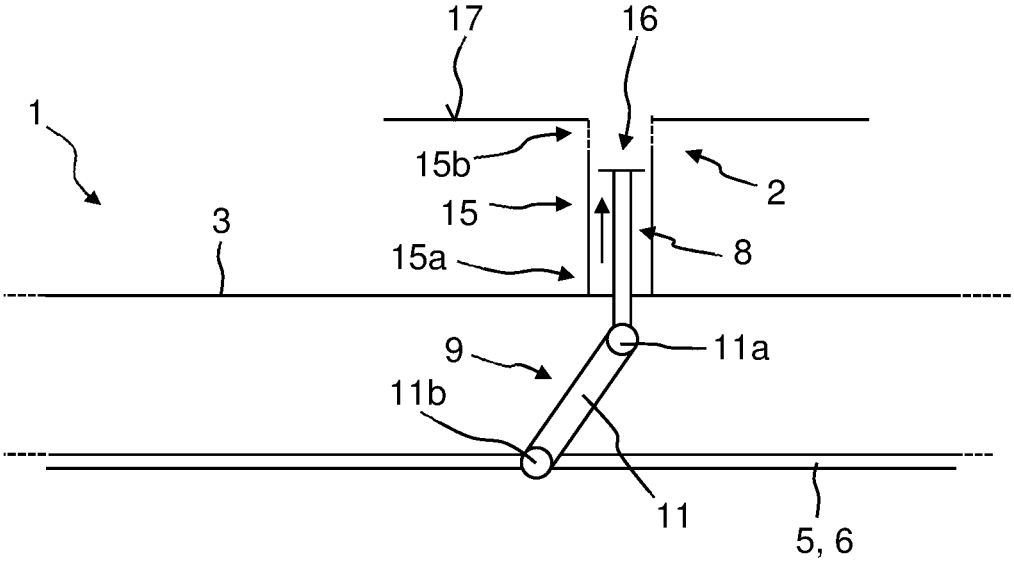

In FIG. 5A the decoupling arrangement 8 is arranged closer to the reflector arrangement 3 than in FIG. 5B. The adjustment rod 6 has moved further to the right (in the direction of the arrow) in FIG. 5B than it was in FIG. 5A.

The decoupling adjustment device 9 comprises a shifting element 11, which comprises a first end 11*a* and a second end 11*b*. The first end of the shifting element is hinged to the decoupling arrangement 8 and is attached or fixated underneath the decoupling arrangement 8 to the decoupling arrangement 8. The second end 11*b* of the shifting element 11 is then again hinged to the adjustment rod 6. By means of the decoupling adjustment device 9, a linear movement of the adjustment rod 6 along its longitudinal axis 5*a* can therefore be converted into a lifting movement of the decoupling arrangement 8 within the balancing and/or support arrangement 15.

In principle, it would also be possible that a guiding arrangement is still provided, whereby the decoupling arrangement is only guided along a straight line by the guiding arrangement. This straight line is perpendicular to the reflector arrangement 3.

The decoupling adjustment device 9 is preferably mainly located on a second side of the reflector arrangement 3, which is free of the dipole-type radiators 2.

Also for FIGS. 5A and 5B it is true that the shifting element 11, which ends with its first end 11*a* below the decoupling arrangement 8, engages with the decoupling arrangement 8 only in the last 40%, 35%, 30%, 25%, 20%, 15%, 10% or 5% of the movement path of the adjustment rod 6 along a first movement direction of the adjustment rod 6, whereby the decoupling arrangement 8 is pressed in direction of the radiator plane only in this region of the movement path.

Figure 9:
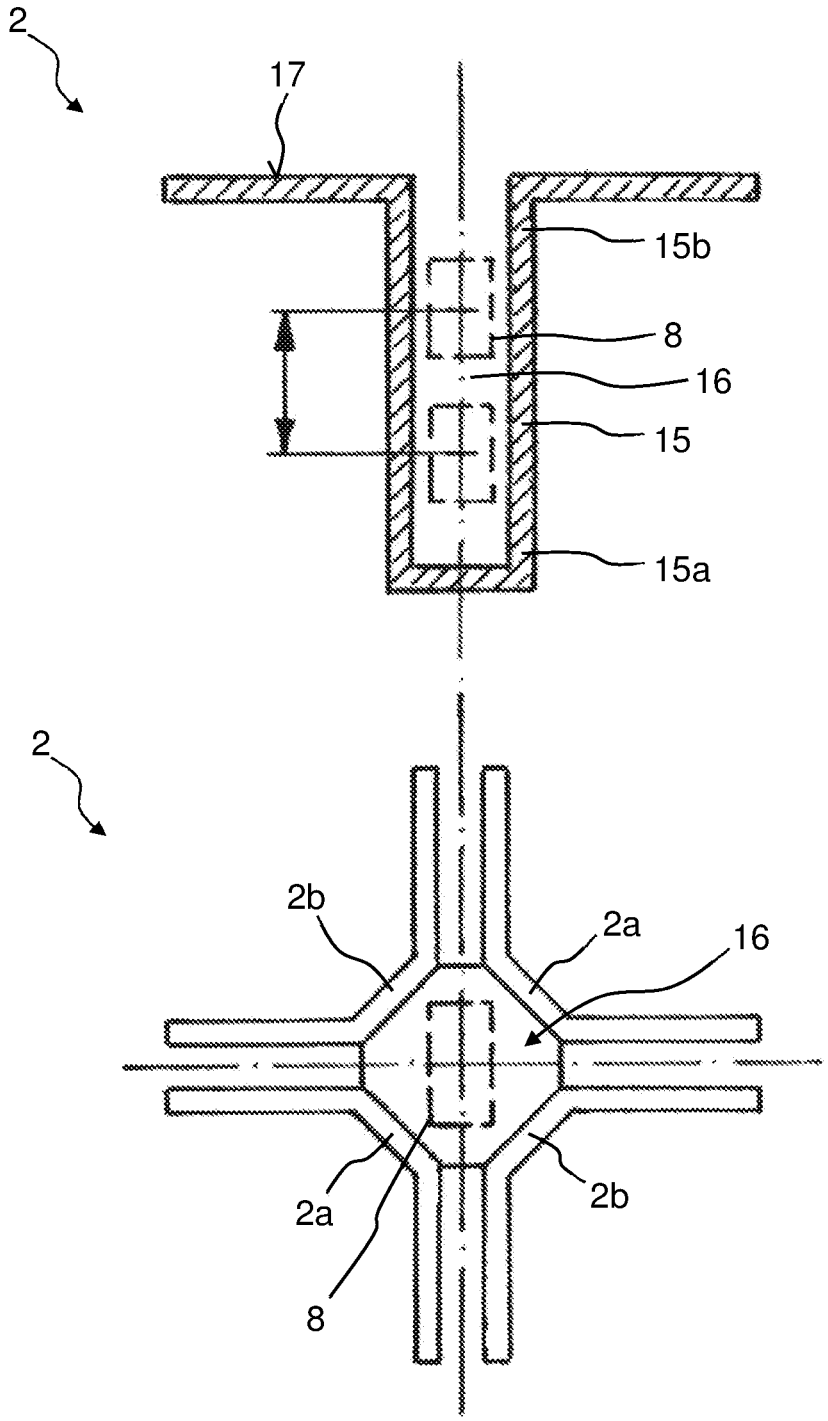
Figure 10A:
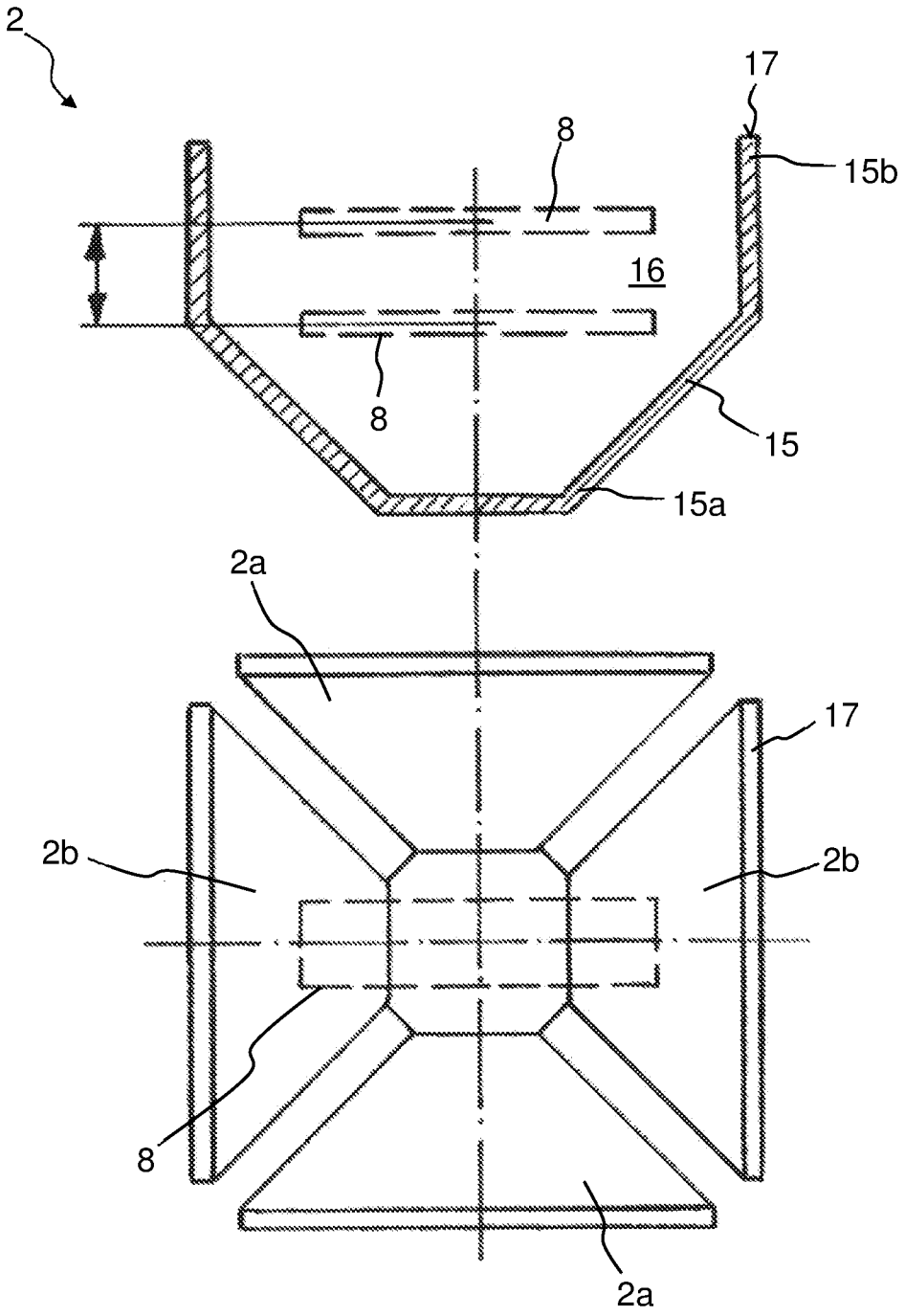

FIGS. 9 and 10A show different arrangements and setups of the dipole-type radiators 2. Shown for both designs are the balancing and/or support arrangement 15 and the receiving room 16. In this receiving room 16 the decoupling arrangement 8 is shown in different positions.

Figure 10B:
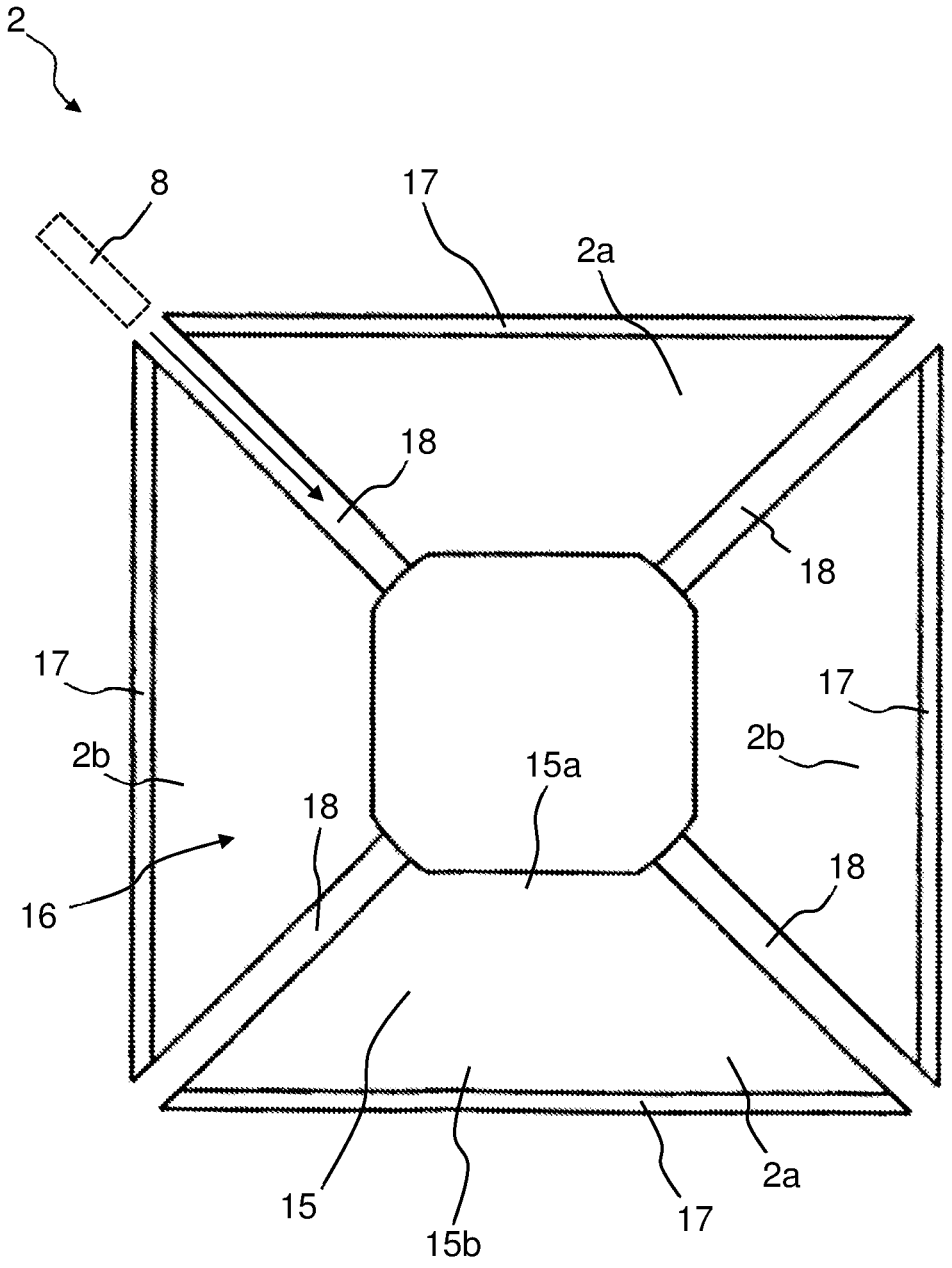

FIG. 10B shows a further embodiment of the radiator 2 according to the invention. It comprises a balancing and/or support arrangement 15 as shown in FIG. 10A. The balancing and/or support arrangement 15 is arranged with its first end 15*a* at the reflector arrangement 3. A second end 15*b* of the balancing and/or support arrangement 15, which is opposite to the first end 15*a*, is further away from the reflector arrangement 3 than the first end 15*a*. Radiator surfaces 17 of the radiator elements 2*a*, 2*b* are arranged at the second end 15*b* of the balancing and/or support arrangement 15. The balancing and/or support arrangement 15 encloses the receiving room 16, which extends from the first end 15*a* to the second end 15*b*. The balancing and/or support arrangement 15 comprises at least one balancing slot 18, which extends from the second end 15*b* over a partial length or over the entire length of the balancing and/or support arrangement 15 towards the first end 15*a*, whereby the receiving room 16 is accessible from outside the radiator 2. The decoupling adjustment device 9 is in contact with the decoupling arrangement 8 and the at least one adjustment rod 6 in such a way that when the adjustment rod 6 is moved or rotated, the at least one decoupling arrangement 8 can be pushed into the receiving room 16 from outside the radiator 2 via the at least one balancing slot 18. This can be achieved by the previously described design (gear wheel arrangement in FIG. 2; driving elements 6*a*, 6*b* in FIGS. 3A to 4B). In this case, the decoupling arrangement 8 is preferably moved in a plane that is approximately parallel (<30°, <20°, <15°, <10°, <5°, <2° or <1° inclined) to the reflector arrangement 3. Of course, there can also be several decoupling arrangements 8, which are inserted into the receiving room 16 through different balancing slots 18.

The decoupling arrangement 8 is preferably arranged at the same distance from the radiator elements 2*a*, 2*b* of both radiators 2, 3.

The radiator 2 according to FIGS. 10A and 10B can in principle be designed as known from the previous publication WO 03/065505 A1, which is referred to in its entirety and which becomes the content of the present application.

Figure 11A:
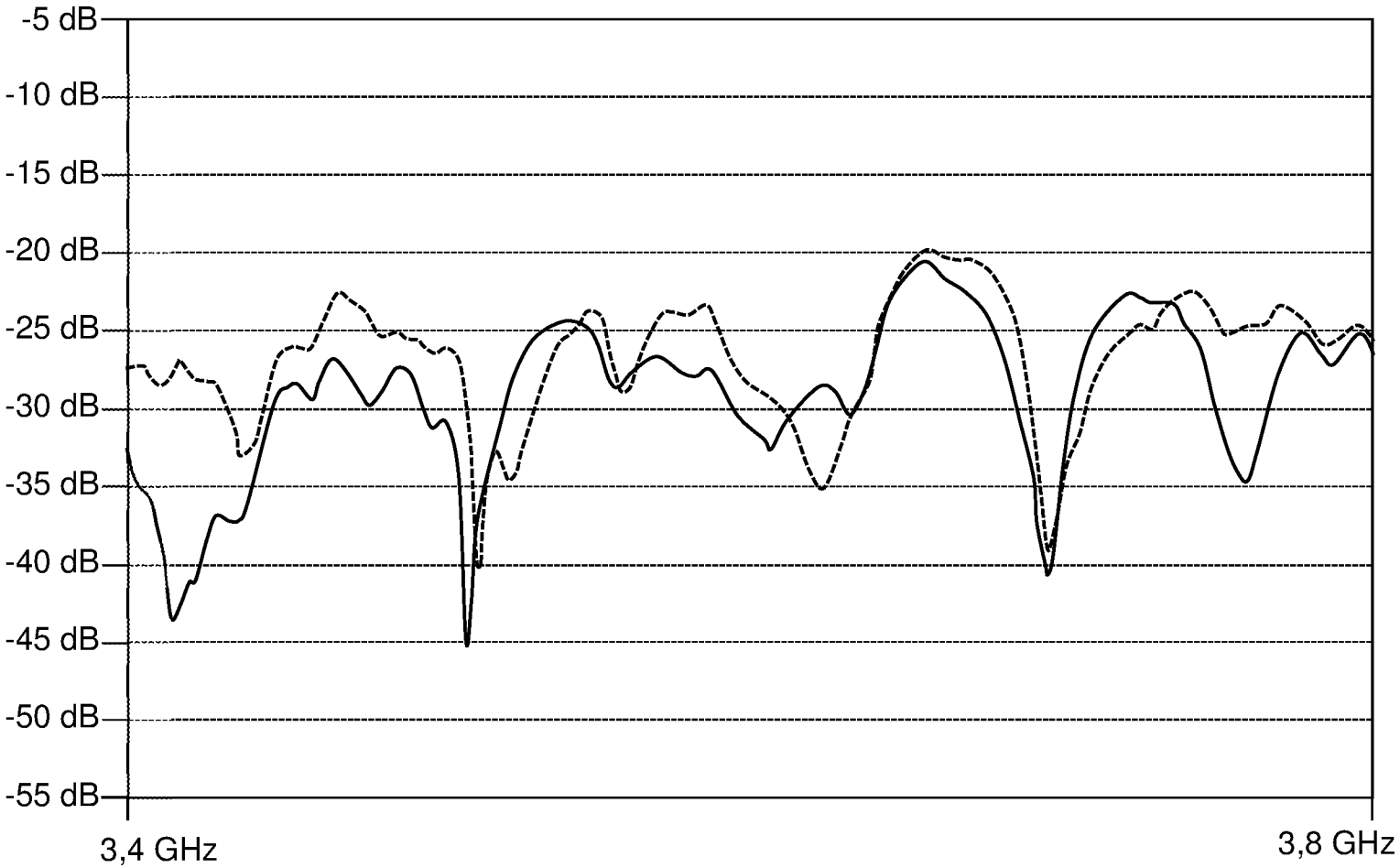

FIGS. 11A and 11B again clearly show the effect of decoupling arrangement 8. FIG. 11A shows the decoupling of both polarizations for the Min-Tilt angle. Dotted lines show the decoupling without the use of the decoupling arrangement 8. With solid lines the decoupling using the decoupling arrangement 8 according to the invention is explained. The lower the value, the better the decoupling. FIG. 11A shows directly that decoupling is improved by using decoupling arrangement 8.

Figure 11B:
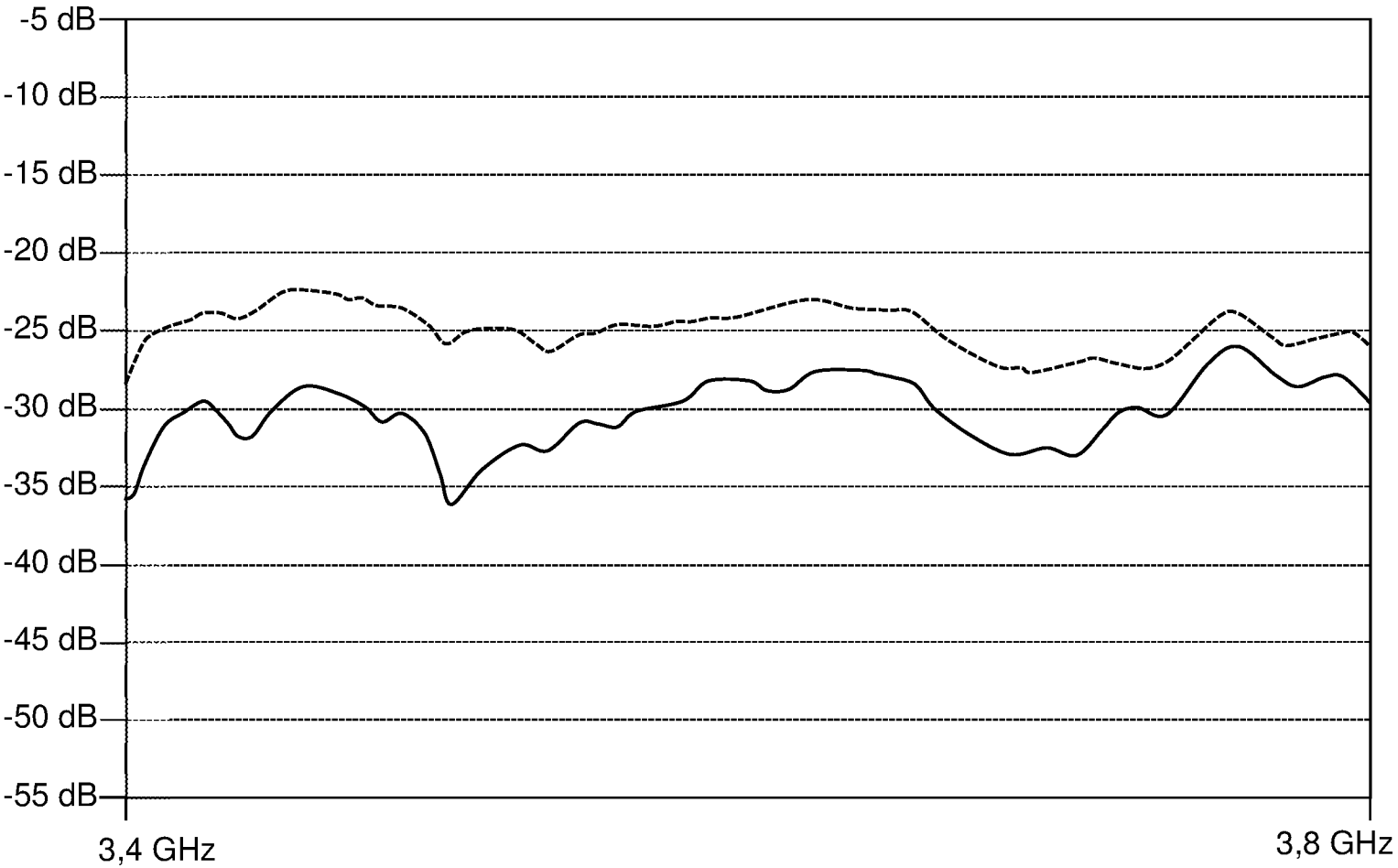

In contrast, FIG. 11B shows the decoupling for the two polarizations at a Max-Tilt angle, with the dashed line showing the decoupling if no inventive decoupling arrangement 8 is used, whereas the solid line describes the decoupling if the decoupling arrangement 8 according to the invention is used. Here it can clearly be seen that an improved decoupling is achieved over the entire frequency range if the decoupling arrangement 8 according to the invention is used.

The invention is not limited to the embodiments described. Within the scope of the invention, all described and/or depicted features can be combined with each other in arbitrary ways.

The invention claimed is:

1. A multiple antenna system for mobile communication, comprising the following features:

at least one group of at least two dual-polarized dipole-type radiators is provided, wherein each dipole-type radiator comprises first and second radiator elements, the first radiator elements are configured to transmit and/or receive in a first polarization plane and the second radiator elements are configured to transmit and/or receive in a second polarization plane, both polarization planes being oriented perpendicular to each other;

a reflector arrangement is provided and the at least one group of at least two dipole-type radiators is arranged on the same side of the reflector arrangement;

a phase shifter arrangement is provided which is connected to the first and second radiator elements and the phase shifter arrangement is configured to:

a) adjust the phase relationships between the at least two first radiator elements with respect to each other; and b) adjust the phase relationships between the at least two second radiator elements;

at least one phase shifter adjustment device is provided, which is mechanically in contact with the phase shifter arrangement and is configured to adjust the phase shifter arrangement; and at least one decoupling arrangement is provided, which is arranged on the same side of the reflector arrangement as the group of at least two dipole-type radiators;

characterized by the following features:

at least one decoupling adjustment device is provided, which is coupled to the at least one decoupling arrangement; and the at least one decoupling adjustment device is mechanically coupled to the phase shifter adjustment device, so that in the event of an adjustment movement of the phase shifter adjustment device, the at least one decoupling arrangement device:

a) is adjustable in width by moving, in a width direction, a first decoupling surface of the at least two decoupling surfaces comprised in the at least one decoupling arrangement device and/or is adjustable in shape by rotating the first decoupling surface of the at least two decoupling surfaces against a second decoupling surface of the at least two decoupling surfaces; or b) is changeable in its position, whereby the change of position is accelerated or only partially synchronized with the adjusting movement of the phase shifter adjustment device; or c) is changeable in its position, wherein the at least one decoupling arrangement is arranged within at least one of the at least two radiators.

2. The multiple antenna system for mobile communication according to claim 1, characterized by the following feature:

the phase shifter adjustment device consists of or comprises an adjustment rod which is movable along its longitudinal axis and/or rotatable around its longitudinal axis to provide the adjustment movement.

3. The multiple antenna system for mobile communication according to claim 2, characterized by the following features:

the at least one decoupling arrangement:

is movable by the decoupling adjustment device only along a certain path of movement or over a certain angular range of rotation of the at least one adjustment rod of the phase shifter adjustment device synchronously therewith, whereby the position of the decoupling arrangement changes; or is adjustable with respect to its distance from the reflector arrangement within the at least one of the at least two radiators, whereby the position of the decoupling arrangement changes.

4. The multiple antenna system for mobile communication according to claim 3, characterized by the following features:

the at least two decoupling surfaces are galvanically connected to each other; or a dielectric is arranged between the at least two decoupling surfaces; or a free space is formed between the at least two decoupling surfaces.

5. The multiple antenna system for mobile communication according to claim 3, characterized by the following features:

both decoupling surfaces are of the same or different size; and/or the decoupling surfaces have the shape of a:

a) n-corner with n≥3, 4, 5, 6, 7, 8, 9 or 10; or b) oval; or c) circle; or d) n-polygons;

or are approximated to such a shape.

6. The multiple antenna system for mobile communication according to claim 3, characterized by the following feature:

both decoupling surfaces run approximately parallel to the reflector arrangement and/or the radiator plane of one or more of the at least two radiators.

7. The multiple antenna system for mobile communication according to claim 3, characterized by the following features:

the decoupling adjustment device comprises a shifting element;

the shifting element comprises a first end and a second end;

the first end of the shifting element is connected to the first decoupling surface;

the second decoupling surface is arranged stationary; and the second end of the shifting element is connected to the adjustment rod, so that during an adjustment movement of the adjustment rod the at least two decoupling surfaces are moved or rotated relative to one another.

8. The multiple antenna system for mobile communication according to claim 3, characterized by the following features:

the decoupling adjustment device comprises a shifting element;

the shifting element comprises a first end and a second end;

the first end of the shifting element is:

a) connected to the first decoupling surface, wherein the second decoupling surface is arranged stationary; or b) connected to the decoupling arrangement;

the adjustment rod comprises a first driving element which is arranged on and projects from the adjustment rod; and the first driving element is arranged on the adjustment rod at such a position that it comes into engagement with the shifting element only in the last 40%, 35%, 30%, 25%, 20%, 15%, 10% or 5% of the movement path, i.e. the adjusting movement along a first movement direction of the adjustment rod, whereby only in this region of the movement path the:

a) two decoupling surfaces are moved or rotated relative to each other; or b) decoupling arrangement is movable synchronously with the adjustment rod only in this region of the movement path of the adjustment rod.

9. The multiple antenna system for mobile communication according to claim 8, characterized by the following features:

the adjustment rod comprises a second driving element which is arranged on the adjustment rod and projects from it;

the second driving element is arranged along the longitudinal axis of the adjustment rod at a distance from the first driving element; and the second driving element is arranged on the adjustment rod at such a position that it engages with the shifting element only along a second movement direction of the adjustment rod, which is in opposite direction of to the first movement direction, whereby the:

a) two decoupling surfaces are moved or rotated relative to each other; or b) decoupling arrangement is movable synchronously with the adjustment rod only in this region of the movement path of the adjustment rod.

10. The multiple antenna system for mobile communication according to claim 3, characterized by the following features:

the decoupling adjustment device comprises a gear wheel arrangement;

the adjustment rod comprises:

1) teeth, which are arranged offset to each other along the longitudinal axis of the adjustment rod; or 2) several screw threads extending along the longitudinal axis of the adjustment rod; and the gear wheel arrangement is permanently in engagement with the adjustment rod and with the first decoupling surface, wherein the second decoupling surface is arranged stationary, wherein the two decoupling surfaces can be moved or rotated relative to one another by displacing or rotating the adjustment rod.

11. The multiple antenna system for mobile communication according to claim 3, characterized by the following features:

the decoupling adjustment device comprises a gear wheel arrangement;

the adjustment rod comprises teeth which are arranged offset to each other along the longitudinal axis of the adjustment rod; and the gear wheel arrangement only comes into engagement with the teeth in the first or last 40%, 35%, 30%, 25%, 20%, 15%, 10% or 5% of the movement path of the adjustment rod along a first movement direction of the adjustment rod, whereby only in this region of the movement path the:

i. two decoupling surfaces are moveable or rotatable relative to one another; or ii. decoupling arrangement is movable synchronously with the adjustment rod only in this region of the movement path of the adjustment rod.

12. The multiple antenna system for mobile communication according to claim 3, characterized by the following features:

the decoupling adjustment device comprises a gear wheel arrangement;

the adjustment rod comprises:

1) teeth, which are arranged offset to each other along the longitudinal axis of the adjustment rod; or 2) several screw threads extending along the longitudinal axis of the adjustment rod; and the gear wheel arrangement comprises at least one eccentric gear wheel which is at least indirectly in engagement with the adjustment rod, whereby the:

i. two decoupling surfaces are acceleratedly moveable or rotatable relative to each other; or ii. decoupling arrangement is adjustable in its position in an accelerated manner.

13. The multiple antenna system for mobile communication according to claim 1, characterized by the following feature:

the decoupling arrangement is enlarged by more than 5%, 10%, 15%, 20%, 25%, 30%, 35%, 40%, 45%, 50%, 55%, 60%, 65%, 70%, 75%, 80%, 85%, 90%, 95% or by more than 100% in plan view with respect to its length and/or width.

14. The multiple antenna system for mobile communication according to claim 2, characterized by the following features:

at least one of the at least two dipole-type radiators comprises a balancing and/or support arrangement;

the balancing and/or support arrangement is arranged with its first end on the reflector arrangement;

a second end of the balancing and/or support arrangement, which is opposite the first end, is further spaced apart from the reflector arrangement;

radiating surfaces of the radiating elements are arranged at the second end of the balancing and/or support arrangement;

the balancing and/or support arrangement encloses a receiving room extending from the first end to the second end;

the decoupling arrangement is partially or predominantly or completely arranged in the receiving room; and the decoupling adjustment device is in contact with the decoupling arrangement and the at least one adjustment rod, so that when the adjustment rod is moved or rotated, the distance of at least one decoupling arrangement to the reflector arrangement is changeable.

15. The multiple antenna system for mobile communication according to claim 14, characterized by the following features:

the decoupling adjustment device comprises a shifting element;

the shifting element comprises a first end and a second end;

the first end of the shifting element is a) hinged to the decoupling arrangement; or b) arranged below the decoupling arrangement on the latter; and the second end of the shifting element is hinged to the adjustment rod.

16. The multiple antenna system for mobile communication according to claim 15, characterized by the following feature:

the shifting element, which is arranged with its first end below the decoupling arrangement, comes into engagement with the decoupling arrangement only in the last 40%, 35%, 30%, 25%, 20%, 15%, 10% or 5% of the movement path along a first movement direction of the adjustment rod, whereby the first end of the shifting element presses the decoupling arrangement from below in the direction of the radiator plane only in this region of the movement path.

17. The multiple antenna system for mobile communication according to claim 15, characterized by the following features:

a guiding arrangement is provided; and the decoupling arrangement is guided by the guiding arrangement only along a straight line.

18. The multiple antenna system for mobile communication according to claim 2, characterized by the following features:

at least one of the at least two dipole-type radiators comprises a balancing and/or support arrangement;

the balancing and/or support arrangement is arranged with its first end on the reflector arrangement;

a second end of the balancing and/or support arrangement, which is opposite the first end, is further spaced apart from the reflector arrangement;

radiating surfaces of the radiating elements are arranged at the second end of the balancing and/or support arrangement;

the balancing and/or support arrangement encloses a receiving room extending from the first end to the second end;

the balancing and/or support arrangement comprises at least one balancing slot which extends from the second end over a partial length or over the entire length of the balancing and/or support arrangement towards the first end, whereby the receiving room is accessible from outside the radiator; and the decoupling adjustment device is in contact with the decoupling arrangement and the at least one adjustment rod in such a way that when the adjustment rod is moved or rotated, the at least one decoupling arrangement can be pushed into the receiving room from outside the radiator via the at least one balancing slot.

19. The multiple antenna system for mobile communication according to claim 1, characterized by the following feature:

the decoupling adjustment device is predominantly arranged on a second side of the reflector arrangement, the second side being free of radiators.

20. The multiple antenna system for mobile communication according to claim 1, characterized by the following feature:

a spring device is provided and arranged on the decoupling arrangement in such a way that the decoupling adjustment device must overcome a spring force of the spring device in order to change the width and/or shape or the position of the decoupling arrangement.

* * * * *